US010758752B2

(12) United States Patent
Kenney

(10) Patent No.: US 10,758,752 B2
(45) Date of Patent: Sep. 1, 2020

(54) NASAL FILTER

(71) Applicant: SPIRARE APS, Risskov (DK)

(72) Inventor: Peter Sinkjaer Kenney, Aarhus N (DK)

(73) Assignee: SPIRARE APS, Aarhus N (DK)

( * ) Notice: Subject to any disclaimer, the term of this patent is extended or adjusted under 35 U.S.C. 154(b) by 1262 days.

(21) Appl. No.: 14/434,343

(22) PCT Filed: Oct. 7, 2013

(86) PCT No.: PCT/DK2013/000066
§ 371 (c)(1),
(2) Date: Apr. 8, 2015

(87) PCT Pub. No.: WO2014/056501
PCT Pub. Date: Apr. 17, 2014

(65) Prior Publication Data

US 2015/0265858 A1 Sep. 24, 2015

(30) Foreign Application Priority Data

Oct. 8, 2012 (DK) ..... 2012 00616

(51) Int. Cl.
*A62B 23/06* (2006.01)

(52) U.S. Cl.
CPC ..... *A62B 23/06* (2013.01)

(58) Field of Classification Search
CPC ..... A62B 23/06
See application file for complete search history.

(56) References Cited

U.S. PATENT DOCUMENTS 2,046,664 A 7/1936 Weaver
2,055,855 A 9/1936 Weaver
2,198,959 A * 4/1940 Clarke ..... A61F 5/08
128/206.11

(Continued)

FOREIGN PATENT DOCUMENTS

CA 2689940 12/2009
CN 2095679 U 2/1992

(Continued)

OTHER PUBLICATIONS

Japan Patent Office, Office Action for Patent Application No. 2015-534913, dated Jun. 27, 2017.

(Continued)

*Primary Examiner* — Timothy A Stanis
*Assistant Examiner* — Jonathan S Paciorek
(74) *Attorney, Agent, or Firm* — Ice Miller LLP

(57) ABSTRACT

A nasal filter (1) comprising a frame (2) with a right and a left frame portion (2*a*, 2*b*) dimensioned for placement inside a left and right nostril, respective, and optionally connected via a U-shaped bridge (4). Each frame portion (2*a*, 2*b*) comprises an anterior support section (6*a*) towards the front of the nose and a posterior support section (6*b*) towards the back of the nose, the support sections supporting a filter element (3). Resilient means (8',9') connect the anterior support section (6*a*) with the posterior support section (6*b*) for flexible change of distance between the anterior support section (6*a*) and the posterior support section (6*b*).

17 Claims, 5 Drawing Sheets

(56) References Cited

U.S. PATENT DOCUMENTS

| | | | | | |
|---|---|---|---|---|---|
| 2,243,360 | A * | 5/1941 | Slatis | A61M 15/08 | 128/206.11 |
| 2,282,681 | A * | 5/1942 | Stotz | A62B 23/06 | 128/206.11 |
| 4,052,983 | A * | 10/1977 | Bovender | A62B 23/06 | 128/204.12 |
| 5,392,773 | A | 2/1995 | Bertrand | | |
| 5,727,543 | A * | 3/1998 | Corsaro | A61F 5/08 | 128/200.24 |
| 7,156,099 | B1 | 1/2007 | Jenkins | | |
| 7,748,373 | B2 | 7/2010 | Toncelli | | |
| 2005/0205095 | A1* | 9/2005 | Dolezal | A62B 23/06 | 128/206.11 |
| 2006/0272640 | A1 | 12/2006 | Abullon | | |
| 2007/0193233 | A1 | 8/2007 | Chen et al. | | |
| 2007/0283963 | A1 | 12/2007 | Sims | | |
| 2008/0053448 | A1* | 3/2008 | Liska | A62B 23/06 | 128/206.11 |
| 2008/0087286 | A1 | 4/2008 | Jones | | |
| 2012/0111334 | A1 | 5/2012 | Moore | | |

FOREIGN PATENT DOCUMENTS

| | | | |
|---|---|---|---|
| DE | 8910651 | U1 | 12/1989 |
| DE | 3914606 | | 11/1990 |
| DE | 3914606 | C2 | 11/1990 |
| DE | 202010001203 | U | 5/2010 |
| EP | 2089115 | | 4/2010 |
| GB | 2289846 | | 12/1995 |
| JP | 2002345976 | | 12/2002 |
| JP | 2002345986 | | 12/2002 |
| JP | 2002345986 | A | 12/2002 |
| JP | 2007021156 | A | 2/2007 |
| JP | 3159887 | U | 6/2010 |
| JP | 2011130843 | A | 7/2011 |
| RU | 2352372 | C2 | 4/2009 |
| WO | 9533520 | | 12/1995 |
| WO | 20051120645 | A2 | 12/2005 |
| WO | 2009097553 | A2 | 8/2009 |
| WO | 2011041921 | A1 | 4/2011 |

OTHER PUBLICATIONS

PCT/DK2013/000066, International Searching Authority, International Search Report, dated Nov. 18, 2013.

PCT/DK2013/000066, International Searching Authority, Written Opinion, dated Sep. 22, 2014.

PCT/DK2013/000066, International Searching Authority, International Preliminary Report on Patentability, dated Sep. 22, 2014.

PA201200616, Danish Patent and Trademark Office, Search Report, dated May 22, 2013.

Russian Patent Office, Search Report for Patent Application No. 2015116596/12 , dated Sep. 27, 2017.

Application No. 2554/CHENP/2015, The Patent Office, Intellectual Property India, Examination Report, dated Apr. 26, 2019.

* cited by examiner

NASAL FILTER

CROSS-REFERENCE TO RELATED APPLICATIONS

The present application is a national stage of and claims the priority benefit of PCT Application Serial No. PCT/DK2013/000066, filed Oct. 7, 2013, which claims the priority benefit of Danish Patent Application Serial No. PA201200616, filed Oct. 8, 2012, the text and drawings of which are hereby incorporated by reference in their entireties.

FIELD OF THE INVENTION

The present invention relates to nasal filters of the type with a frame onto which a filter is attached, for example a planar filter. Especially, it relates to a nasal filter comprising a frame with a right and a left frame portion dimensioned for placement inside a right and left nostril, for example connected via a U-shaped bridge.

BACKGROUND OF THE INVENTION

Filtering of inhaled air is one of the primary functions of the human anterior nasal cavity and upper respiratory tract. The natural filtration mechanism functions as a safeguard against particles being deposited in the lower airways or ultimately in the bronchi.

However, the natural filtration of particles, where especially particles above 10 microns are deposited on the nasal mucosa membrane, can for some individuals be an extreme nuisance, as they develop allergic responses against these particles. In order to protect humans against unwanted particles while breathing, a variety of filters have been developed, a selection of which is described in the following.

For terminology reasons, it should be noted that the vertical central wall of the nose between the left and right nostril is typically called the medial wall or septum of the nose and ends at the low end of the nose, which is called the columella. The nostrils are largely delimited by the septum and the lateral parts, which are the outer wings of the nostrils, bending from the edge of the septum at the tip of the nose to the back edge of the septum near the head skeleton. The forward direction towards the tip of the nose is termed anterior and the back of the nose towards the skull is termed posterior.

Personal air filtering devices can be divided into two main categories: facial masks that cover both mouth and nose and nasal filters that solely cover the nose. Nasal filters can be sub-divided into externally placed nasal filters and internally placed nasal filters.

Many nasal filters have one filter unit for each nostril, the filter units being connected via a U-formed, flexible bridge that clips around the columella of the nose and holds the filter units in place inside the nostrils. The filter units are often elongate with a longitudinal direction and a transverse direction; when inserted into the nose, the longitudinal direction of the filter extends from the anterior part of the nostril at the tip of the nose to the posterior part of the nostril near the skull, and the transverse direction extends from the septum of the nose to the lateral part of the nose.

Existing internally placed nasal filters can be categorized broadly into cone-like devices and flat filter devices. The advantages of the former are argued to be flexibility, steady positioning, larger surface areas for filtration and level of comfort, for example as disclosed in US patent or patent applications U.S. Pat. Nos. 2,055,855, 7,748,383, US2007/0193233 and US2005/0205095. The advantages of the latter are argued to be minimal visibility, invasiveness, and increased comfort of use.

Substantially flat filter type devices are disclosed in Canadian patent application CA26589940, British patent application GB2289846, German patent laid open document DE3914606A1, Japanese patent application JP2002-345986A, German utility model DE202010001203U1, US patents and applications U.S. Pat. No. 2,046,664, US228268, U.S. Pat. Nos. 5,392,773, 7,156,099, US2007/0283963, US2008/0087286, US2012/0111334, and International patent applications WO2005/120645, WO2009/097553, and WO2011/041921.

In order for an internal nasal filter to work well, be acceptable and attractive to the user in daily life, it must fulfil some basic objectives: It must be near to invisible, it must allow adequate air movement without a steep increase in resistance while breathing, it most remove what it is claiming to remove, it must be able to accommodate a variety of nasal sizes and shapes, it must substantially follow the curvature of the nasal cavity so that all inhaled air passes through the filtration mechanism, and finally it must be comfortable to wear.

The primary drawback of cone-like structures is generally the sheer mass of material that has to be placed in the nasal cavity. This increases visibility of the filter; lowers the available space for airflow, thus, increasing resistance; and feels uncomfortable for users, thus, lowering compliance.

The primary drawbacks of flat nasal filters are generally their lack of flexibility and adaptability, their tendencies to wobble during nasal movement and breathing, which leaves loopholes for the inhaled air and their transverse position in the cavity that results in pain, especially when touching the nose.

Both cone-like nasal filters and flat filters have been made in one and two or more component solutions where the basic argument for introducing more components has been the idea of having exchangeable parts. The most basic drawback of these systems is the increased resistance to airflow that occurs because the material takes up too much space in the nasal cavity.

All of the above mentioned general drawbacks have resulted in lower adaptability among potential users than what would be expected if all of the basic objectives were reached.

European Patent EP2089115B1 describes an internal nasal filter comprising lunette-shaped filtering components on an oval support that is connected to a flexible U-shaped bridge that functions as a clip around the lower edge of the cartilage of the nose. The ends of the flexible U-shaped element (from hereon referred to as shanks) are placed substantially perpendicular to the flexible U-shaped element. This results in the shanks and the filter being perpendicular to the air stream, which makes sense from a filtration perspective. However, it also results in increased resistance as the shanks are placed in the primary air stream thus resulting in laboured breathing. Furthermore the angle at which the shanks are placed and their solidity results in discomfort when touching or moving the nose. Although, EP2089115B1 utilises the idea of using the more flexible filtering components to adjust for different nose sizes and variations, the embodiments of its shanks lack the ability to uphold a filtering component without internal stiffness. This results in discomfort because of the necessary stiff structural characteristics of the filtering components and their perpendicular angle to the nasal canal. It also results in gaps along the curvature of the nasal cavity through which unfiltered air is inhaled.

It is therefore desirable to provide improvements in the art.

DESCRIPTION/SUMMARY OF THE INVENTION

It is the purpose of this invention to fulfil the above-mentioned objectives and overcome the general drawbacks of the prior art, especially the cone-like and flat filters as well as the specific drawbacks mentioned above. Especially it is the objective to provide a nasal filter that is efficient and comfortable to wear.

This purpose is achieved with a nasal filter according to the following.

The nasal filter comprises a frame with a right and a left frame portion dimensioned for placement inside a right and left nostril, respective. Each frame portion comprises an anterior support section configured for being directed towards the front of the nose when the nasal filter is inserted into a nose. Also, each frame portion comprises a posterior support section configured for being directed towards the back of the nose when the nasal filter is inserted into a nose. The anterior support section and the posterior support section support a filter element, for example a substantially planar filter element.

Each frame portion comprises resilient means connecting the anterior support section with the posterior support section for flexible change of distance between the anterior support section and the posterior support section.

In the following, the term "relaxed state" is used to indicate that the described shapes are intrinsic for the nasal filter, which means that they exist when the filter is not exerted to forces that deform the filter. For example, a bend as part of the nasal filter is meant to exist without deformation by force exerted on the filter. The described shapes in the following are all meant to be intrinsic features of the filter.

For example, this is in contrast to the disclosure in the aforementioned GB2289846, where circular frame around a filter element is deformed by manual force into a heart-like shape with a bend between opposite sections of the circular frame.

In the following, also the terms "upwards" and "downwards" will be used, despite the fact that the nasal filter, in principle, can have all orientations before, and even after, being inserted into a nose. However, it appears, nevertheless, justified and appropriate for simplicity to use the terms "upwards" or "downwards" in a commonly understood way. The term "downwards" and "below the filter element" will be used in the directions away from the filter element and towards that part of the nasal filter that is close to the columella, whereas the term "upwards" and "above the filter element" will be used for the opposite direction.

The terms "anterior" or "posterior" are used for those parts that are configured to be placed towards the anterior or posterior part of the nostril. The terms "medial" and "lateral" are used for those parts of the nasal filter that are directed towards the medial part or lateral part of the nose, respectively.

The term "radius of curvature" is used in the following for a vector that has offset in a point on a curve, has a length equal to the radius of a circle approximating the bending of the curve in that point and has a direction of such radius at that point.

The advantage of such a nasal filter is a comfortable and efficient placement and adjustment of the nasal filter when inserted into the nose. As the anterior and posterior support sections are connected resiliently, the frame portions can easily shorten and adapt, for example by additional sideways resilient motion and twist, when inserted into the nose, which is advantageous for the fit and user comfort. In addition, when producing the nasal filter in a flexible polymer material, for example silicone or a thermoplastic elastomer, the frame fits comfortably into various shapes and sizes of noses.

Optionally, the two frame portions are connected by a flexible bridge, for example a substantially U-shaped bridge, for elastic fastening of the bridge across the columella of the nose and against the cartilage on either side of the medial septum of the nose. As an option, the frame resembles largely a U-formed bridge with two approximately lunette-shaped frame portions. The U-shaped bridge, when produced in transparent polymer, for example silicone or a thermoplastic elastomer, is barely visible for other people when a user wears such a filter.

The anterior support section has a medial segment and a lateral segment, where the medial segment is near or at the septum and the lateral segment is near or at the lateral wall of the nostril when the nasal filter is inserted into the nose. The posterior support section has a medial sector and a lateral sector, where the medial sector is near or at the septum and the lateral sector is near or at the lateral wall of the nostril when the nasal filter is inserted into the nose.

Advantageously, the resilient means comprises a medial resilient member flexibly connecting the medial segment with the medial sector. This way, the medial sector, the medial resilient member, and the medial segment in combination form a medial side of the frame portion. The medial side is that part of the frame portion that is configured for being directed towards the septum when the nasal filter is inserted into a nose. The medial resilient member is configured for flexible change of distance between the medial segment and the medial sector.

Alternatively, or in addition, the resilient means comprises a lateral resilient member flexibly connecting the lateral segment with the lateral sector. This way, the lateral sector, the second resilient means, and the lateral segment in combination form a lateral side of the frame portion. The lateral side is that part of the frame portion that is configured for being directed towards the lateral part of the nose when the nasal filter is inserted into a nose. The lateral resilient member is configured for flexible change of distance between the lateral segment and the lateral sector.

In some embodiments, the resilient means comprises material bents or spirals, which is a non-exhaustive list of examples.

The anterior support section has an anterior support surface for supporting the filter element; and the posterior support section has a posterior support surface for supporting the filter element. For the filter element, the anterior support surface and the posterior support surface define a filter support plane for the filter element. The filter element will follow the shape of this filter support plane when the nasal filter is in a relaxed state and not deformed by exerting force on it, such as force exerting by fingers when being in the process of inserting the nasal filter into the nose. Such a plane can be straight or bent in the relaxed state of the resilient means, the bending being possible in either direction in order to be concave or convex, although it will typically be convex.

For example, the anterior support surface is angled between 5 and 40 degrees relatively to the posterior support surface along a line from the backmost point of the posterior support section to the frontal point of the anterior support section in order for supporting the filter element in a bent state. By arranging the filter element in a bent state, bending from the posterior to the anterior, the nasal filter is more flexible and easier to adjust inside the nose with a better tightness between the filter and the inner walls of the nostrils.

A reference plane can be defined for the frame as follows. The anterior support section of each frame portion has a frontal point configured for being directed towards the front of the nose when the nasal filter is inserted into a nose; and the posterior support section of each frame portion has a backmost point configured for being directed towards the back of the nose when the nasal filter is inserted into a nose; due to symmetry, these two frontal points and the two backmost points in common define a reference plane. This reference plane is also uniquely defined by a normal vector perpendicular to the reference plane.

In a concrete embodiment, the medial resilient member comprises a medial bend to provide a resilient connection between the medial sector and the medial segment. This bend exists when the nasal filter is in a relaxed state. Advantageously, this medial bend extends outside the filter support plane. For example, the medial bend is directed substantially downwards, and has a bottom, when the nasal filter is inserted into a nose. The bottom of a bend can be defined as that point within the bend that has the largest distance to the reference plane. For example, the medial bend extends largely perpendicular to the reference plane, for example within plus or minus 20 degrees from the normal of the reference plane. For example, the medial bend has a radius of curvature (for example the radius of curvature at a bottom of the medial bend) that has a direction, the direction forming an angle of 0-20 degrees with the normal vector. The fact that the direction of a radius of curvature of the bend is within 20 degrees of the direction of the normal vector does not necessarily imply that the entire medial resilient member, or rather the entire medial bend, only has radii of curvature within this angular region, as the resilient member can be formed rather complex and also would extend to the support sections and be connected to the support sections. However, the medial bend would have at least one radius of curvature, for example the radius of curvature at a bottom of the medial bend, having a direction within this angular region. For example, the direction of the radius of curvature at the bottom of the bend is largely perpendicular to the reference plane, where the term largely perpendicular means within 20 degrees with the normal vector, for example within 10 or 5 degrees with the normal vector. For example, this substantially vertical arrangement of the medial bend is advantageous in that the medial bend acts as a medial spring between the anterior and posterior support section. For example, if the medial side is planar and parallel to a symmetry plane between the two frame portions, the angle is measured from this symmetry plane.

Alternatively, the medial bend could be directed upwards or is a combination of a downwards bend and an upwards bend.

In case that the nasal filter is provided with a U-shaped bridge, the medial bend can be part of or merge into the legs of the U-shaped bridge.

For example, the lateral resilient member has a lateral bend to provide a resilient connection between the lateral sector and the lateral segment. This bend exists when the nasal filter is in a relaxed state. Advantageously, this lateral bend extends outside the filter support plane. For example, the lateral bend is directed substantially downwards, and has a bottom, when the nasal filter is inserted into a nose. The bottom of a bend can be defined as that point within the bend that has the largest distance to the reference plane. For example, the lateral bend is within plus or minus 45 degrees from the normal of the reference plane. For example, it has a radius of curvature (for example the radius of curvature at the bottom of the lateral bend) that has a direction within 45 degrees with the normal of the reference plane. The fact that the direction of a radius of curvature of the bend is within 45 degrees with the normal does not necessarily imply that the entire lateral resilient member only has radii of curvature within this angular region, as the resilient member can be formed rather complex. However, the lateral bend would have at least one radius of curvature having a direction within this angular region, for example the radius of curvature at the bottom of the lateral bend. Thus, the lateral bend on the lateral side is not necessarily strictly downwards directed. It may, for example, bend outwards towards the lateral side of the nostril. This can be an advantage for a better tightness of the filter element against the lateral side of the nose. The lateral bend acts as a lateral spring between the anterior and posterior support section.

As a further alternative, the lateral bend is directed upward or is a combination of a downwards bend and an upwards bend; optionally, within the same angular interval.

In some embodiment, the frame portions are configured to touch one or more of the inner walls of the nose and, optionally, extending along the inner walls in order to tighten against the inner walls of the nostrils. However, in some embodiments, the frame portions do not contact the inner wall of the nostril, but the frame supports a filter element that contacts the inner walls of the nostril. In this case, the filter element is dimensioned larger than an area spanned by the anterior and posterior support sections, such that the filter element extends outside the spanned area.

In some embodiments, the posterior support section has a downward slope in the direction from the medial sector towards the lateral sector, where the downward slope forms an angle of 45-85 degrees to the normal of the reference plane. For example, the downward slope forms an angle of 5-45 degrees with a plane parallel to the symmetry plane between the right and left frame portions.

For the filter element, various options are given, for example woven or non-woven materials in one layer or a plurality of layers; foam materials; pleated filter materials; porous membrane materials; perforates materials; materials with constant or varying mesh size; materials with varying diameters; single layer or multiple layers; multiple layers of meshes where each mesh has a constant mesh size but the various layers have mutually different mesh size; multiple layers with each layer having varying mesh sizes; planar filters; corrugated filters; especially, flexible filters. Typically, a polymer material for the filter element is preferred. A useful filter material has been found in a polymer non-woven fabric, for example a non-woven, spunbond fabric. The useful material is described in greater detail below.

For the purpose of removing particles larger than 15 microns, for example equivalent to most pollen's diameter, a specific material has been found useful. The useful material is made of polymer fibres distributed randomly in a horizontal plane and sequentially deposited on top of each other to build a structure with a thickness of between 0.05 mm and 1 mm, advantageously between 0.07 and 0.2 mm. The diameters of the fibres are between 15 and 30 micron, the fibres being considered mono-diameter fibres. The material contains on average 5-18 fibres stacked in the height direction, although it is pointed out that the number of stacked fibres varies greatly because of the random distribution. The distance between two fibres, which are level in a horizontal plane, is mainly between 0.05 and 0.4 mm. The overall mesh sizes of the material vary greatly depending on the distance between individual fibres in the same horizontal plan and the random distribution of fibres in the levels above and below the individual fibres. In general the average mesh size is larger than the diameter of the particles that the material is filtering. The weight of the material is advantageously between 5 and 40 g/m2.

Well knowing that the mesh sizes are much larger than dust particles and larger than many types of pollen, it has surprisingly been found that such filter material is very efficient for filtering the air through the nose. The reason being that the filter material acts not only by sieving the air flow, where particles larger than a certain mesh size are held back, but the filter material also work by adsorption, where particles are adsorbed to the fibres despite being smaller than the size of the mesh. Due to the multi layer arrangement of the filter material, the air creates turbulences while traversing the filter material, which promotes adsorption of particles to the fibres.

The term "between" with respect to intervals given for values between a first and a second specific value has to be understood as also including the end points of the interval.

SHORT DESCRIPTION OF THE DRAWINGS

The invention will be explained in more detail with reference to the drawings, where FIG. 1 is a photo of three nasal filters in different sizes;

DETAILED DESCRIPTION/PREFERRED EMBODIMENT

Figure 1:
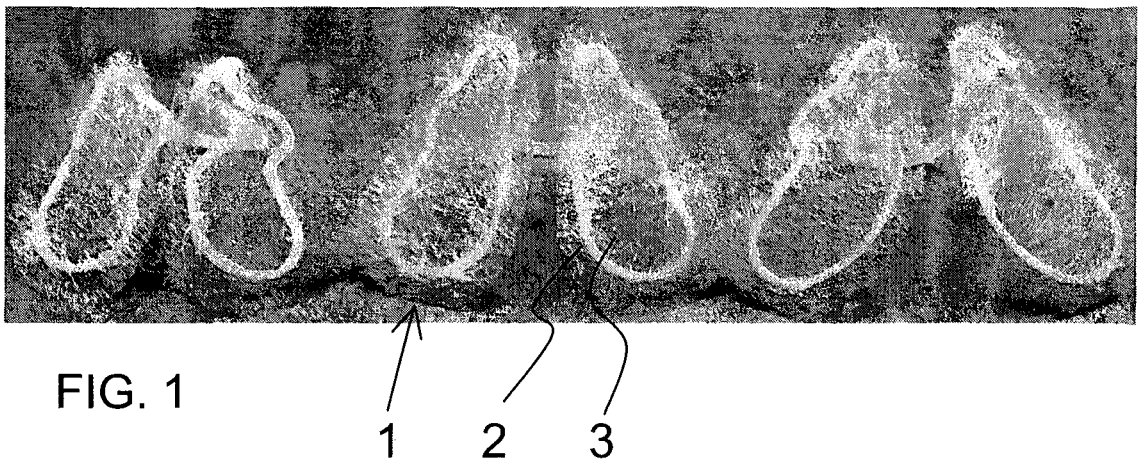

FIG. 1 shows a photograph of some prototypes in various sizes of a nasal filter 1, the nasal filter having a frame 2 and a filter element 3 attached to the frame 2.

Figure 2A:
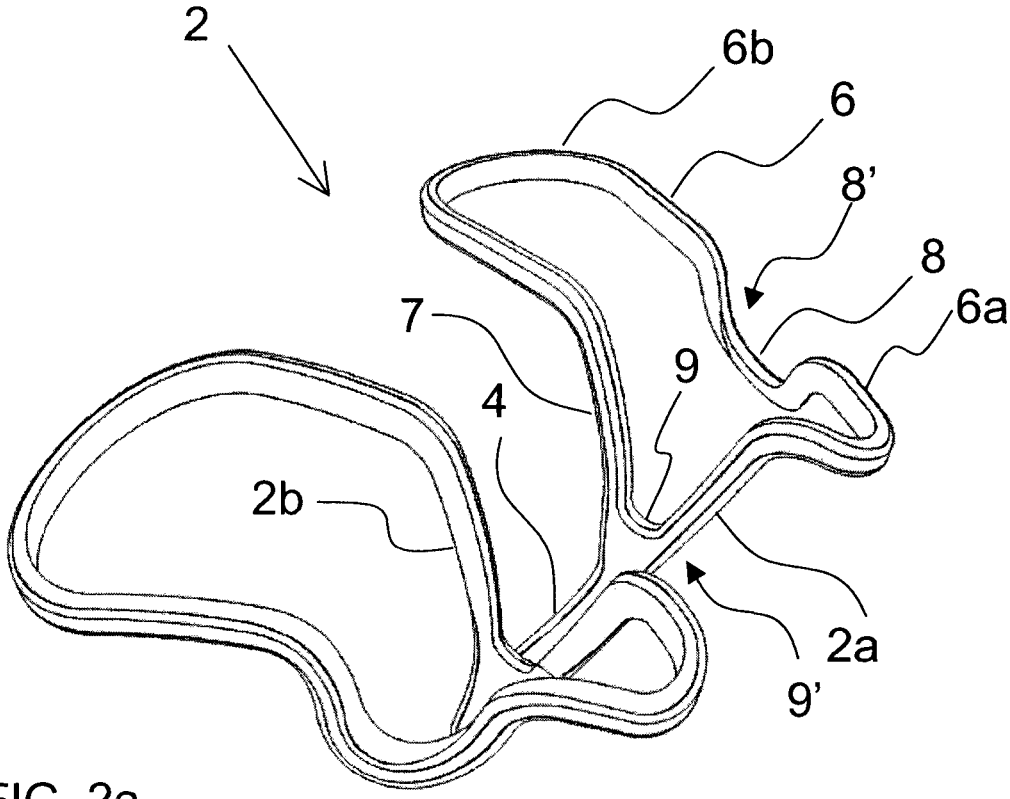
FIG. 2 illustrates a three dimensional view of a frame of a nasal filter in a) a skew perspective view, b) a front view, c) a side view and d) a back view.

FIG. 2*a* is a perspective view of one embodiment of a frame 2 of a nasal filter. The frame 2 comprises a U-formed bridge 4 connecting the medial sides of a left frame portion 2*a* and a right frame portion 2*b*. The bridge 4 acts as a clip, or part of a clip, around the columella of the nose.

Figure 2B:
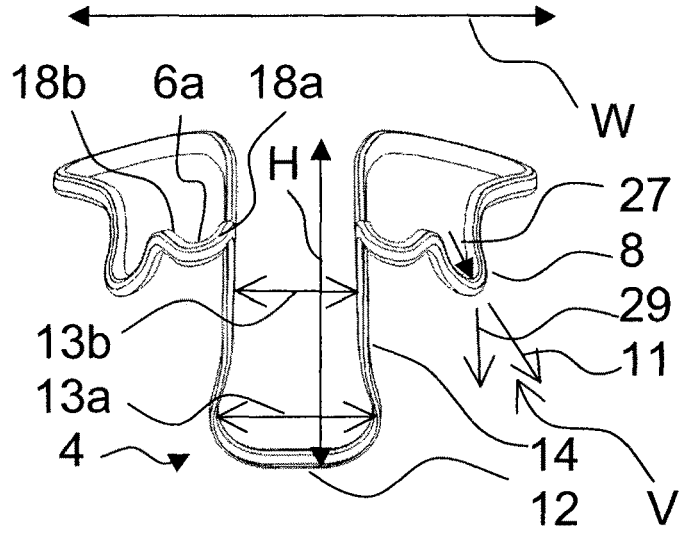
Figure 2C:
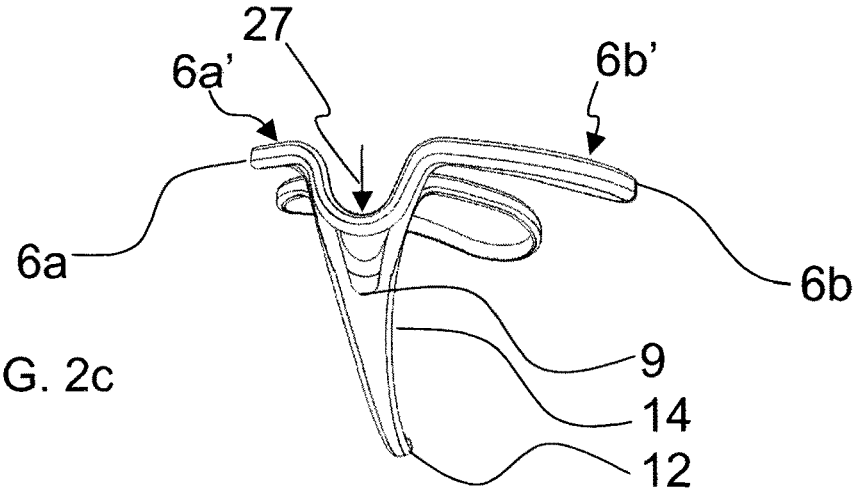
Figure 2D:
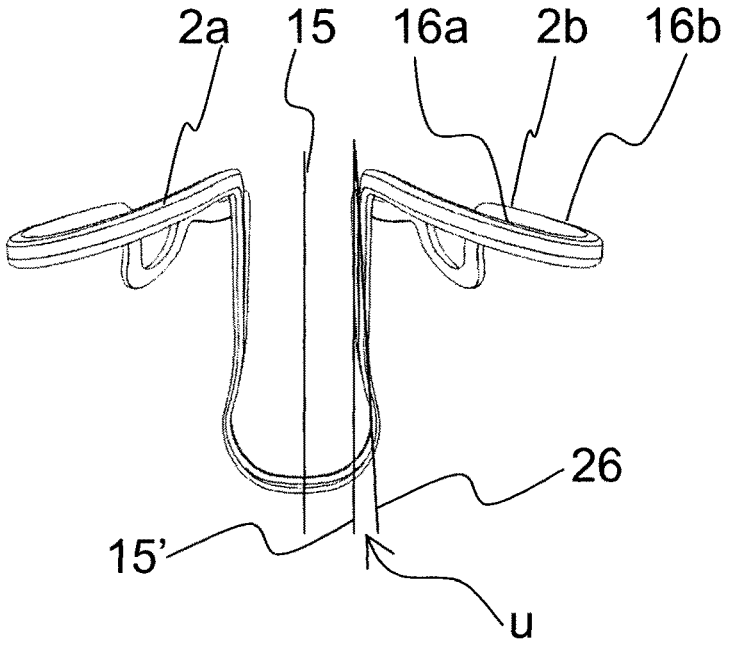

FIGS. 2*b*, 2*c*, and 2*d* are different perspectives of the same frame as in FIG. 2*a*, namely a view from the front, side, and back, respectively.

Each of the frame portions 2*a*, 2*b* comprises a support section 6 and a connector 7 connecting the bridge 4 with the support section 6. The support section 6 is that part of the frame 2 that supports the filter element 3. The bridge 4 acts as a clip around the columella of the nose; or the bridge 4 in combination with the connector 7 acts as a clip around the columella of the nose. The bridge 4 and the connector 7 are those parts of the frame 2 that clip around the cartilage of the septum and, when in use by a standing person, extend upwards and inwards along the septum of the nose. The support section 6 is arranged to support the filter element 3 that extends across the nostril. Typically, the support section 6 extends across the nostril or surrounds the nostril along the nostril wall in order to support the filter element 3. The support section 6 defines a plane for the filter element, actually a convex, bent plane. Alternatively, the plane could be straight or concavely bent. With reference to the embodiment of FIG. 1, it is seen that the area spanned by the support section 6 is designed to be smaller than the area of the filter element 3 such that the support section 6 does not necessarily touch the inner walls of the nostrils during use of the nasal filter 1, however, the filter element would touch the inner wall of the nostrils when the nasal filter is in proper use. The fact that the filter material extends outside the support section 6 is not strictly necessary but usually is more comfortable.

As the filter 1, when in use, has a typical orientation when being used by a standing person, it is appropriate to use the terms "upwards" and "downwards", "above" and "below" for the relative arrangements of the parts of the filter without thereby introducing ambiguity, as it is also customary to describe the nose of a person with upper and lower parts, despite the fact that a person can be lying down or hanging upside down. The terms "anterior" or "posterior" are used for those parts that are configured to be placed towards the anterior or posterior part of the nostril. The terms "medial" and "lateral" are used for those parts of the nasal filter that are directed towards the medial part or lateral part of the nose, respectively.

The support section 6 comprises an anterior support section 6*a* that supports the filter element 3 at the anterior part of the nostril, and the support section 6 has a posterior support section 6*b* that supports the filter element 3 at the posterior part of the nostril. The anterior support section 6*a* adjusts to different noses and guides the device into its correct position by being flexible due to the resilient means described in more detail in the following.

Figure 7:
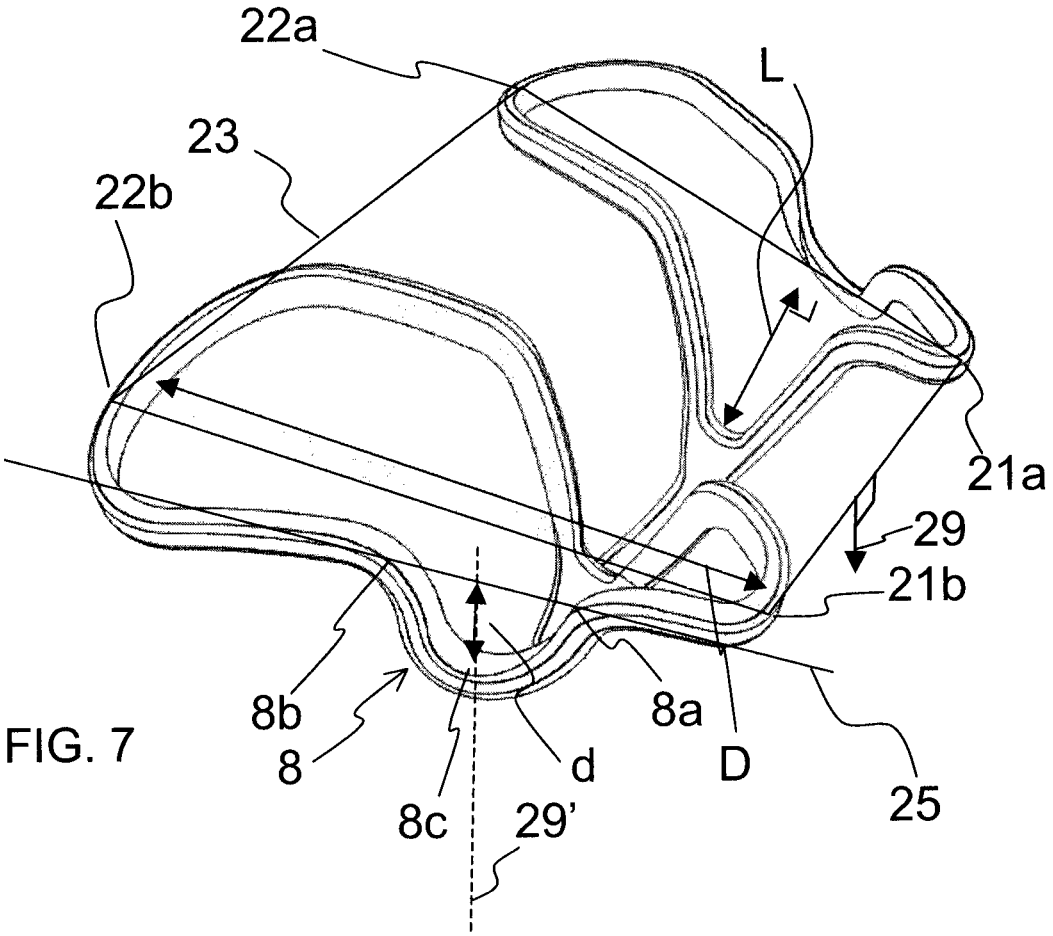
FIG. 7 illustrates the same frame as in FIG. 2*a* with a reference plane for illustration of geometrical terminology.

In the following, a reference plane 23 is referred to as illustrated in FIG. 7. The reference plane 23 is defined by the two frontal points 21*a*, 21*b* of the anterior support sections 6*a*, and the two most backward points 22*a*, 22*b* of the posterior support sections 6*b*. The term "downwards direction" is used for a direction perpendicular to the reference plane 23 and is meant to be towards the nose entrance for a normally standing person when using the nasal filter, although it is pointed out that noses differ and downwards does not necessarily mean vertically downwards for a standing person. The term "upwards" is used for the opposite direction. A direction perpendicular to the reference plane 23 is defined by the normal vector 29 of the reference plane 23, the normal vector 29 defining the orientation of the reference plane 23 in space.

Figure 3A:
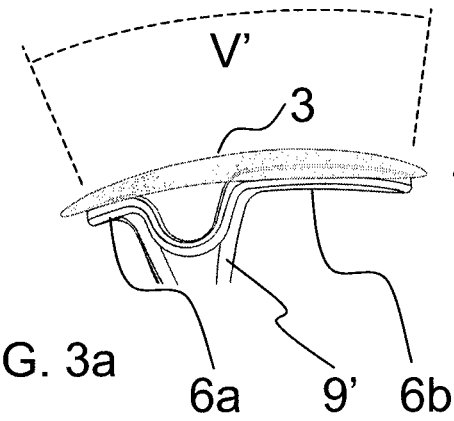
FIG. 3 illustrates one frame portion with a filter element in a) a side view and b) a top view.
Figure 3B:
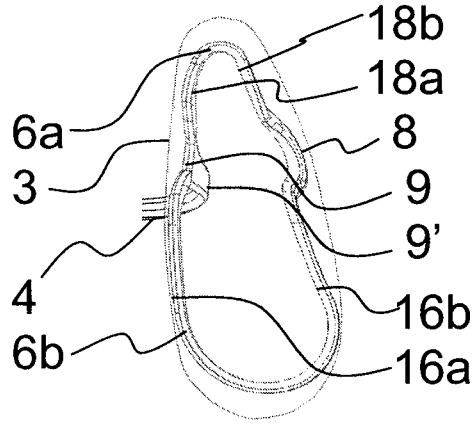

As illustrated in FIG. 3*b*, the anterior support section 6*a* comprises a medial segment 18*a* and a lateral segment 18*b* where the medial segment 18*a* is near or at the septum, when the nasal filter is inserted into the nose, and the lateral segment 18*b* is near the lateral wall of the nostril. The posterior support section 6*b* has a medial sector 16*a* and a lateral sector 16*b*, where the medial sector 16*a* is near or at the septum when the nasal filter is inserted into the nose, and the lateral sector 16*b* is near the lateral wall of the nostril.

With reference to FIG. 2*a*, between the anterior support section 6*a* and the posterior support section 6*b*, a lateral resilient member 8' is provided, comprising a lateral bend 8 as part of a lateral side of the frame portion 2*a*, 2*b*. As best seen in FIG. 3*b*, the lateral resilient member 8' with the lateral bent 8 is configured for flexible change of distance between the lateral segment 18*b* and the lateral sector 16*b*. In the shown embodiment, the lateral bend 8 connects the lateral segment 18*b* with the lateral sector 16*b*.

Also, between the anterior support section 6*a* and the posterior support section 6*b*, a medial resilient member 9' is provided comprising a medial bend 9 as part of a medial side of the frame portion 2*a*, 2*b*. As best seen in FIG. 3*b*, the medial resilient member 9' with the medial bent 9 is configured for flexible change of distance between the medial segment 18*a* and the medial sector 16*a*. In the shown embodiment, the medial bend 9 connects the medial segment 18*a* with the medial sector 16*a*.

With reference to FIG. 2*a*, the lateral bend 8 connects the anterior support section 6*a* and the posterior support section 6*b* on the lateral side of the frame portion 2*a*, 2*b*. Likewise, the medial bend 9 connects the anterior support section 6*a* and the posterior support section 6*b* on the medial side of the frame portion 2*a*, 2*b*. In the shown drawing, it appears that the medial bend 9 is part of the connector 7. The bends 8, 9 give the support section 6 a high flexibility as compared to a support section that would be formed by a closed ring as disclosed in GB2289846.

The concavity of the illustrated lateral bend 8 is shaped predominantly circular, although this regularity is not necessary. The illustrated concavity of the medial bend 9 has a predominant V-shape with rounded bottom, although this regularity is not necessary, thus, resembling the advantages of a cone-like structure in terms of stability combined with the minimalism of a flat structure in order to utilise the best of both structures. Whereas the lateral bend 8 provides a certain degree of flexibility between the anterior support section 6*a* and the posterior support section 6*b* and at the same time stability against wobbliness, the medial bend 9 provides a certain degree of flexibility between the anterior support section 6*a* and the posterior support section 6*b* and at the same time stability along the septum.

Both bends 8 and 9 are shown as being directed substantially downwards relatively to the support section 6 and relatively to the reference plane 23, which however is not strictly necessary, as one of these or both could as well be bent upwards, although the downwards bends 8, 9 are believed to be more comfortable for the user. It is pointed out that the term "downwards" means from the support section 6 in the direction towards the lower end of the nose, where the bridge bends around the columella. As best illustrated in FIGS. 2*b* and 2*c* with additional reference to FIG. 7, the direction of the radius of curvature 27 in the bottom of the lateral bend has a direction which has an angle V with the normal 29 of the reference plane, the angle V being 0-45 degrees, for example 10-45 degrees. Thus, the direction of the lateral bend is primarily downwards, although it could alternatively be upwards or a combination of an upwards lateral bend and a downwards lateral bend. As an example, in case that the anterior support section 6*a* and the posterior support section 6*b* as well as the lateral bent 8' are in a common plane, all the radii of curvature for the bend would be in this plane. The radius of curvature at the bottom of the bend would have an angle with the normal of the reference plane given by 90 degrees minus the angle between the normal vector of the reference plane and the normal vector of such plane.

The bends 8, 9 result in the filter element 3 being supported only in the front part of the nostril by the anterior support section 6*a* and in the back part of the nostril by the posterior support section 6*b*, whereas there is a region between the anterior support section 6*a* and the posterior support section 6*b* where the filter element 3 is not supported. The effect is a better adjustment of the filter element 3 inside the nose, resulting in a better tightness of the filter element 3 in the nostril. It increases the overall comfort of the device and helps in securing the device along the curvature of the nasal cavity. Advantageously in this connection, the filter element 3 has a low stiffness and is easily bendable when the frame 2 is inserted into the nose and the anterior support section 6*a* and the posterior support section 6*b* are pushed towards each other in order to adjust to the shape of the nostril.

The flexibility of the frame portions 2*a*, 2*b* in the direction from the anterior support section 6*a* to the posterior support section 6*b*, due to the lateral bend 8, depends on the depth of the lateral bend 8 apart from other parameters such as the material stiffness and its thickness. The depth is defined as follows with reference to FIG. 7. On the transition between the lateral bend 8 and the anterior support section 6*a*, there is a first point 8*a* of largest convex curvature, and on the transition between the lateral bend 8 and the posterior support section 6*b*, there is a second point 8*b* of largest convex curvature; these two points define a line 25. In case that the lateral bend 8 has a part with constant curvature, the first point 8*a* and the second point 8*b* are defined as the midpoints of the arch having constant curvature.

The depth of the lateral bend 8 is thus defined as the distance d between the line 25 and the most downward point 8*c* of the lateral bend 8 when measured along a direction 26 perpendicular to the reference plane 23, which is the direction given by the normal vector 29. Such a distance d is at least 5% and typically between 10% and 30% of the distance D between the foremost point 21*b* of the anterior support section and the backmost point 22*b* of the posterior support section. In less mathematical terms, the depth d of the lateral bend is typically between 10% and 30% of the length D of the frame portion 2*a,b* that is placed in the nose. For the medial bend 8, the depth is much larger, typically, between 10% and 80% of the length of the frame portion 2*a,b*.

The directions of the medial bend 9 and the lateral bend 8 are typically substantially downwards, that is, largely perpendicular to the reference plane 23. However, the direction of the lateral bend 8 may deviate from the downward direction in order to assist in a better fitting of the nasal filter in the nose of the user. As is best seen in FIG. 2*b*, in the presented embodiment, the direction as illustrated by the skew arrow 11 of the lateral bend 8 is not truly downwards like the normal vector 29 but only substantially downwards towards the columella in that the lateral bend 8 bends slightly towards the lateral parts of the nose, which makes it flexible not only in the direction from the front to the back of the nostril but also sideways, while still maintaining a structural stability in the nose. It is pointed out for sake of completeness that the illustrated arrow 11 in FIG. 2*b* has the same direction as the illustrated arrow 27 for the direction of the radius of curvature in the bottom of the lateral bend in FIG. 2*c*

Also best seen in FIG. 2*b*, the bridge 4 is substantially U-formed with a flat bottom 12 and legs 14 in order to receive the lowest part of the septum of the nose between the legs 14. Thereby, the bridge 4 is least visible, especially, when the frame is made in a transparent material. The bridge 4 has a first width 13*a* between the legs proximal to the bottom 12, which is larger than a second width 13*b* between the legs 14 distal to the bottom 4. Thus, the curvature from the bottom 12 of the U-shaped bridge changes from concavity into convexity in the upwards direction along the legs 14. This is advantageous for securing the device in the nose and to the septum without impeding air flow. The U-shaped bridge ads slight pressure to the septum wall for holding frame 2 in its correct position and keeping it in position during exercise and breathing.

As it appears best from FIG. 2*c*, the upper surface 6*a*' of the anterior support section 6*a* and the upper surface 6*b*' of the posterior support section 6*b* are mutually angled with a mutual angle V', for example of between 5 and 45 degrees, as it is shown in greater detail in the side view of FIG. 3*a*. This results in the filter element 3 being bent from the anterior to the posterior relatively to a horizontal plane 23. The shape is useful in guiding the user when inserting the nasal filter and placing it in a correct position. It also helps the user in placing the nasal filter correctly along the inner walls of the nostrils, thereby minimising gaps despite the curvature of the nasal cavity. The feature also ads to the flexibility of the nasal filter, which is important for comfort experienced by the user and the tightness of the filter element 3 against the inner walls of the nostrils.

As also illustrated in FIG. 2*c*, the legs 14 of the U-shaped bridge 4 need not necessarily be straight but may curve between the bottom 12 of the bridge 4 and the support section 6. This curvature is, typically, substantially in a plane 15' parallel to the symmetry plane 15 between the left frame portion 2*a* and the right frame portion 2*b*, the symmetry plane being illustrated in FIG. 2*d*. This curvature of the legs 14 in a plane 15' parallel to the symmetry plane 15 helps as a guide when inserting the filter and assists in positioning the device in the desired position, for example such that the bridge is least visible. The leg 14 in combination with the bend 9 resembles a shape as the letter Y.

As it also appears from FIG. 2*b* in comparison to FIG. 7, the legs 14 of the U-shaped bridge 4 are typically not perpendicular to the reference plane 23 but have a small angle of less than 90 degrees, advantageously an angle of 0 to 10 or 10 to 20 or 20 to 30, for example 5 to 10 or 5 to 20, degrees with the normal 29 of the reference plane 23. Such an angle of around 5 or 10 or 15 degrees from the normal 29 to the reference plane 23 results in a better fit of the frame in the nose. In case that the legs 14 are provided in a plane 15' parallel to the symmetry plane 15, the angle, with a slight exaggeration indicated as u in FIG. 2*d*, is measured from this plane 15'. It may have a direction on either side of this plane 15'.

FIG. 3*b* shows a top view of the filter 3 on the support 6. The lateral dimensions of the filter element 3 are larger than the area spanned by the support section 6, such that the filter element 3 extends farther towards the walls of the nostrils than the support section 6 in order for the filter element 3 to tighten against the inner walls of the nostrils. For example, the filter element extends between 0.5 and 1.5 mm outside the support section 6. The larger size of the filter element 3 assists in closing gaps between the frame 2 and the inner walls of the nostrils as to accommodate small nasal cavity variations among people; further, depending on the filtering element, it also increases the tolerance and overall comfort of the embodiment, because it works as a cushioning mechanism.

To a certain extend, this principle is known from the initially mentioned publication European patent EP2089115B1. However, the area spanned by the support section 6 is larger relatively to the area of the filter element in that the filter element advantageously is only between 3% and 30% larger than the area spanned by the support section 6, whereas in EP2089115B1, the area of the filter element is more than 100% larger (more than twice as large).

As illustrated in FIG. 3*b*, the posterior support section 6*b* has a medial sector 16*a* and a lateral sector 16*b*, where the medial sector 16*a* is near or at the septum when the nasal filter is inserted into the nose and the lateral sector 16*b* is near the lateral wall of the nostril. As indicated in FIG. 2*d*, the posterior support section 6*b* has a downward slope in the direction from the medial sector 16*a* towards the lateral sector 16*b*. This downward slope is typically 45-85 degrees, for example in the range of 70-80 degrees, relatively to the normal 29 of the reference plane 23. This slope increases the flexibility of the device and allows the users to be able to touch their noses without feeling discomfort. Likewise, optionally, the anterior support section can be sloped for increasing the comfort.

Figure 4:
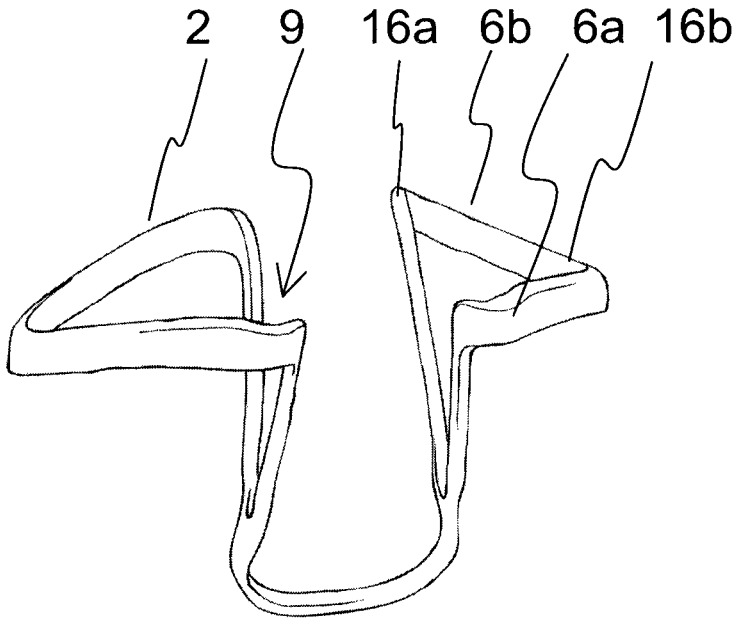
FIG. 4 illustrates a first alternative embodiment of a frame.

FIG. 4 illustrates one possible alternative embodiment, showing the alternative frame 2 from a skew front view. The frame 2 comprises only a medial bend 9 and not a lateral bend. The anterior support section 6*a* merges with the posterior support section 6*b* on the lateral sector 16*b* of the posterior support section 6*b*. The downwards slope of the support section 6 has a typical angle of 45-85 degrees with the normal vector 29; however, it is more pronounced with a steeper angle from the medial sector 16*a* to lateral sector 16*b* than illustrated in the model as shown in FIG. 2*d*. In this embodiment, primarily, the medial bend 9 assists in flexibility of the frame 2 in the direction from the front to the back of the nostril.

Figure 5:
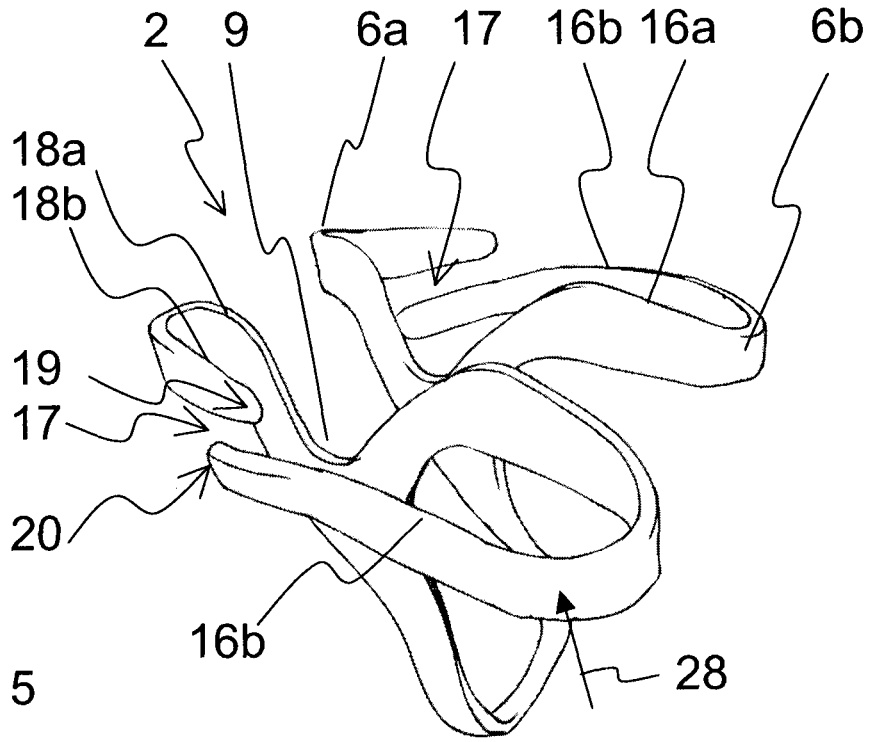
FIG. 5 illustrates a second alternative embodiment.

FIG. 5 illustrates a skew view from the side of a further alternative embodiment of a frame 2 for a nasal filter. In this embodiment, the frame 2 comprises medial bends 9 but not lateral bends. Instead, the lateral sector 16*b* of the posterior support section 6*b* is not directly connected to the anterior support section 6*a* but decoupled from the anterior support section 6*a*. The anterior support section 6*a* has a medial segment 18*a* configured for placement towards the septum and a lateral segment 18*b* configured for placement against the lateral inner wall of the nostril. The lateral segment 18*b* of the anterior support section 6*a* and the lateral sector 16*b* of the posterior support section 6*b* are not directly connected but only indirectly through the medial segment 18*a*, the medial bend 9 and the medial sector 16*a*. A gap 17 is provided between lateral segment 18*b* of the anterior support section 6*a* and the lateral sector 16*b* of the posterior support section 6*b*. In the shown embodiment, lateral segment 18*b* of the anterior support section 6*a* has a first end 19 and the lateral sector 16*b* of the posterior support section 6*b* has a second end 20 on either side of the gap 17. The open structure provided by the disconnection between the anterior support section 6*a* and the posterior support section 6*b* on the lateral side of the frame portion provides flexibility and adaptability for the frame 2.

As a further alternative, the lateral sector 16*b* of the posterior support section 6*b* could be substantially shorter than illustrated, for example as short such that it ends at the indicated end point of the arrow 28.

Instead of having a bend on the medial side and a gap on the lateral side, this could be reversed in that the medial side is built up similar to the illustrated lateral side with the gap 17, and the lateral side has a bend instead, much like the bend as illustrated in FIG. 2*a*.

Figure 6:
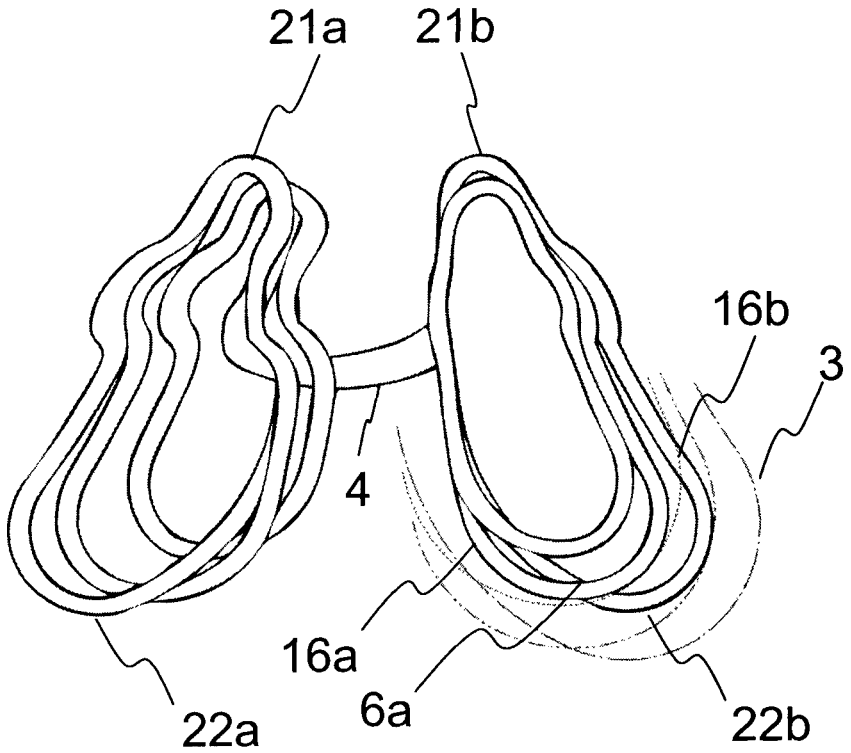
FIG. 6 is a stacked view of three different sized frames.

FIG. 6 shows a series of frames with different sizes graphically superimposed on each other. The constructed image illustrates that, in these embodiments, the shapes of the frames are not directly scaled, but the shapes of the frames are adjusted according to the size. Especially, the medial sector 16*a* of the posterior support section 6*b* has a different shape in dependence on the size of the frame 2. For increasing size, the medial sector 16*a* bends relatively more outwards for the larger frames than for the smaller frames. Thus, the angle between the lateral sides of the two frame portions 2*a*, 2*b* is larger for the larger models than for the smaller.

Figure 8:
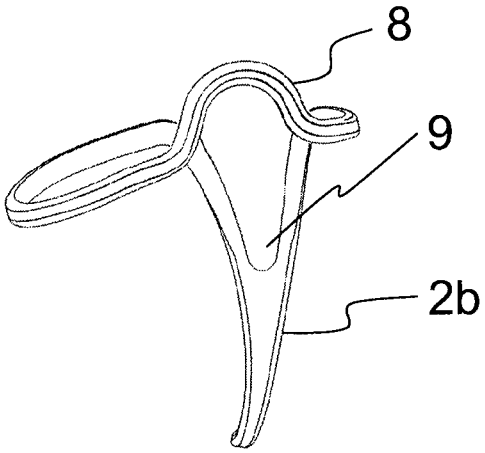
FIG. 8 illustrates an alternative embodiment showing a single frame portion with an upwards lateral bend and a downwards medial bend.

FIG. 8 illustrates an embodiment, where the lateral bend 8 is bending upwards, whereas the medial bend 9 is bending downwards. Only the right frame portion 2*b* is shown for reasons of simplicity. In this case, it may be advantageous that the filter element is within the frame and does not extend outside the frame.

Some typical, although not limiting intervals for dimensions for adult use are given in millimetres (mm) in the following, whereas it is pointed out that the dimensions for nasal filters for children would be smaller. The dimensions are given for three types of filters, small/medium/large:

depth d of the lateral bend 8 as measured from line 25 (see FIG. 7): 1.5-5 or 2.5-4;

length D from frontal point 22*a*, 22*b* to backmost point 21*a*, 21*b* (see FIG. 7): 10-14/12-16/15-20 or 11-13/14-16/17-20;

the depth L of the medial bend 9 as measured from the bottom of the bent to the reference plane 23 (see FIG. 7): 4-8/5-8/6-9 or 5-8/6-8/6-9;

the width 13*a* near the bottom 12 of the U-shaped bridge 4 (see FIG. 2*b*): 4-6/5-7/5-7 the width 13*b* between the legs 14 remote from the bottom 12 of the U-shaped bridge 4 (see FIG. 2*b*): 3-5/4-6/4-6 width W of the frame as illustrated in FIG. 2*b:* 14-21/16-22/19-26 or 15-20/16-21/19-22;

overall height H of the nasal filter as illustrated in FIG. 2*b:* 8-14/10-15/12-17 or 10-14/14-15/14-16.

The filter element is advantageously a woven or non-woven mesh type filter. A variety of methods of attaching the filter element 3 to the support element 6 exist, including but not limited to gluing, welding, melting, laser techniques and casting.

The invention claimed is:

1. A nasal filter comprising a left and right frame portion dimensioned for placement inside a left and right nostril of a nose, respective;

each frame portion comprising an anterior support section configured for being directed towards a front of the nose when the nasal filter is inserted into the nose; each frame portion being made from a flexible polymer material; and each frame portion comprising a posterior support section configured for being directed towards a back of the nose when the nasal filter is inserted into the nose;

the anterior support section and the posterior support section supporting a filter element;

each frame portion comprising resilient means connecting the anterior support section with the posterior support section for flexible change of distance between the anterior support section and the posterior support section;

wherein a) the anterior support section has a medial segment and a lateral segment and extends from a medial side to a lateral side of the nose along an anterior inner part of the nose when inserted into the nose, and the posterior support section has a medial sector and a lateral sector and extends along a posterior inner part of the nose when inserted into the nose; the resilient means comprising a medial resilient member flexibly connecting the medial segment with the medial sector; whereby the medial sector, the medial resilient member, and the medial segment in combination form a medial side of the frame portion configured for being directed towards the septum when the nasal filter is inserted into a nose; the medial resilient member being configured for flexible change of distance between the medial segment and the medial sector; wherein the medial resilient member, when the nasal filter is in a relaxed state, comprises a medial bend as a resilient connection between the medial sector and the medial segment; wherein the medial bend has a predominant V-shape with a rounded bottom, the V-shape being formed by a first leg and a second leg connected to the rounded bottom, the first leg being connected to the medial sector and the second leg being connected to the medial segment in order for the V-shaped medial bend to resiliently connect the medial sector with the medial segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the medial bend extends outside the filter support plane when the nasal filter is in a relaxed state;

or b) the anterior support section has a lateral segment, and the posterior support section has a lateral sector; the resilient means comprising a lateral resilient member flexibly connecting the lateral segment with the lateral sector; whereby the lateral sector, the resilient means, and the lateral segment in combination form a lateral side of the frame portion configured for being directed towards the lateral part of the nose when the nasal filter is inserted into a nose; the lateral resilient member being configured for flexible change of distance between the lateral segment and the lateral sector; wherein the lateral resilient member, when the nasal filter is in a relaxed state, comprises a lateral bend as a resilient connection between the lateral sector and the lateral segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the lateral bend extends outside the filter support plane when the nasal filter is in a relaxed state;

or both a) and b).

2. A nasal filter according to claim 1, wherein the medial bend is directed downwards or upwards relatively to the filter; or wherein the lateral bend is directed downwards or upwards relatively to the filter; or both.

3. A nasal filter according to claim 2, wherein the medial bend is directed downwards and has a bottom when the nasal filter is inserted into a nose; or wherein the lateral bend is directed downwards and has a bottom when the nasal filter is inserted into a nose; or both.

4. A nasal filter comprising a left and right frame portion dimensioned for placement inside a left and right nostril of a nose, respective;

each frame portion comprising an anterior support section configured for being directed towards a front of the nose when the nasal filter is inserted into the nose; each frame portion being made from a flexible polymer material; and each frame portion comprising a posterior support section configured for being directed towards a back of the nose when the nasal filter is inserted into the nose;

the anterior support section and the posterior support section supporting a filter element;

each frame portion comprising resilient means connecting the anterior support section with the posterior support section for flexible change of distance between the anterior support section and the posterior support section;

wherein a) the anterior support section has a medial segment, and the posterior support section has a medial sector; the resilient means comprising a medial resilient member flexibly connecting the medial segment with the medial sector; whereby the medial sector, the medial resilient member, and the medial segment in combination form a medial side of the frame portion configured for being directed towards the septum when the nasal filter is inserted into a nose; the medial resilient member being configured for flexible change of distance between the medial segment and the medial sector; wherein the medial resilient member, when the nasal filter is in a relaxed state, comprises a medial bend as a resilient connection between the medial sector and the medial segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the medial bend extends outside the filter support plane when the nasal filter is in a relaxed state; wherein the anterior support section of each frame portion has a frontal point configured for being directed towards the front of the nose when the nasal filter is inserted into a nose; and the posterior support section of each frame portion has a backmost point configured for being directed towards the back of the nose when the nasal filter is inserted into a nose; the two frontal points and the two backmost points defining a reference plane with a normal vector perpendicular to the reference plane; wherein the medial bend is largely perpendicular to the reference plane;

or b) the anterior support section has a lateral segment, and the posterior support section has a lateral sector; the resilient means comprising a lateral resilient member flexibly connecting the lateral segment with the lateral sector; whereby the lateral sector, the resilient means, and the lateral segment in combination form a lateral side of the frame portion configured for being directed towards the lateral part of the nose when the nasal filter is inserted into a nose; the lateral resilient member being configured for flexible change of distance between the lateral segment and the lateral sector; wherein the lateral resilient member, when the nasal filter is in a relaxed state, comprises a lateral bend as a resilient connection between the lateral sector and the lateral segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the lateral bend extends outside the filter support plane when the nasal filter is in a relaxed state;

or both a) and b).

5. A nasal filter according to claim 4 wherein if the anterior support section has a medial segment, the medial bend is within a range of plus or minus 20 degrees from the normal vector of the reference plane.

6. A nasal filter according to claim 4 wherein if the anterior support section has a medial segment, the medial resilient member has a medial bend with a radius of curvature that has a direction forming an angle in the interval of 0-20 degrees with the normal vector.

7. A nasal filter according to claim 6, wherein if the anterior support section has a medial segment, the medial bend has a bottom and the radius of curvature at the bottom of the medial bend has a direction forming an angle in the interval of 0-20 degrees with the normal vector.

8. A nasal filter according to claim 1, wherein each frame portion is connected by a flexible bridge that is made from the same flexible polymer material as each frame portion and is integral with each frame portion, the bridge comprising a bottom and two legs extending from the bottom, for fastening the bridge across the columella of the nose and against the cartilage with one leg on either side of the medial septum of the nose; wherein the medial bend is part of or merges into the leg of the bridge.

9. A nasal filter according to claim 1, wherein the anterior support section has a lateral segment, and the posterior support section has a lateral sector; the resilient means comprising a lateral resilient member flexibly connecting the lateral segment with the lateral sector; whereby the lateral sector, the lateral resilient means, and the lateral segment in combination form a lateral side of the frame portion configured for being directed towards the lateral part of the nose when the nasal filter is inserted into a nose; the lateral resilient member being configured for flexible change of distance between the lateral segment and the lateral sector.

10. A nasal filter according to claim 1, wherein if the anterior support section has a lateral segment, the anterior support section of each frame portion has a frontal point configured for being directed towards the front of the nose when the nasal filter is inserted into a nose; and the posterior support section of each frame portion has a backmost point configured for being directed towards the back of the nose when the nasal filter is inserted into a nose; the two frontal points and the two backmost points defining a reference plane with a normal vector perpendicular to the reference plane; wherein the lateral bend is within a range of plus or minus 45 degrees from the normal vector of the reference plane.

11. A nasal filter according to claim 10, wherein if the anterior support section has a lateral segment, the lateral bend has a radius of curvature that has a direction forming an angle in the interval of 0-45 degrees with the normal vector.

12. A nasal filter according to claim 11, wherein if the anterior support section has a lateral segment, the lateral bend has a bottom and the radius of curvature at the bottom of the lateral bend has a direction forming an angle in the interval of 0-45 degrees with the normal vector.

13. A nasal filter comprising a left and right frame portion dimensioned for placement inside a left and right nostril of a nose, respective;

each frame portion comprising an anterior support section configured for being directed towards a front of the nose when the nasal filter is inserted into the nose; each frame portion being made from a flexible polymer material; and each frame portion comprising a posterior support section configured for being directed towards a back of the nose when the nasal filter is inserted into the nose;

the anterior support section and the posterior support section supporting a filter element;

each frame portion comprising resilient means connecting the anterior support section with the posterior support section for flexible change of distance between the anterior support section and the posterior support section;

wherein the anterior support section comprises a lateral segment and the posterior support section comprises a lateral sector;

wherein a) the anterior support section has a medial segment and a lateral segment and extends from a medial side to a lateral side of the nose along an anterior inner part of the nose when inserted into the nose, and the posterior support section has a medial sector and a lateral sector and extends along a posterior inner part of the nose when inserted into the nose; both the lateral segment and the lateral sector being configured for placement against the lateral inner wall of the nostril, wherein the lateral segment and the lateral sector are disconnected by a gap between the lateral segment and the lateral sector; the resilient means comprising a medial resilient member flexibly connecting the medial segment with the medial sector; whereby the medial sector, the medial resilient member, and the medial segment in combination form a medial side of the frame portion configured for being directed towards the septum when the nasal filter is inserted into a nose; the medial resilient member being configured for flexible change of distance between the medial segment and the medial sector; wherein the medial resilient member, when the nasal filter is in a relaxed state, comprises a medial bend as a resilient connection between the medial sector and the medial segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the medial bend extends outside the filter support plane when the nasal filter is in a relaxed state;

or b) the anterior support section has a lateral segment, and the posterior support section has a lateral sector; the resilient means comprising a lateral resilient member flexibly connecting the lateral segment with the lateral sector; whereby the lateral sector, the resilient means, and the lateral segment in combination form a lateral side of the frame portion configured for being directed towards the lateral part of the nose when the nasal filter is inserted into a nose; the lateral resilient member being configured for flexible change of distance between the lateral segment and the lateral sector; wherein the lateral resilient member, when the nasal filter is in a relaxed state, comprises a lateral bend as a resilient connection between the lateral sector and the lateral segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the lateral bend extends outside the filter support plane when the nasal filter is in a relaxed state;

or both a) and b).

14. A nasal filter according to claim 1, wherein the filter element is dimensioned 3%-30% larger than an area spanned by the anterior and posterior support sections, and the filter element thereby extending outside the spanned area in order for the filter element to contact and tighten against the inner walls of the nostrils.

15. A nasal filter comprising a left and right frame portion dimensioned for placement inside a left and right nostril of a nose, respective;

each frame portion comprising an anterior support section configured for being directed towards a front of the nose when the nasal filter is inserted into the nose; each frame portion being made from a flexible polymer material; and each frame portion comprising a posterior support section configured for being directed towards a back of the nose when the nasal filter is inserted into the nose;

the anterior support section and the posterior support section supporting a filter element;

each frame portion comprising resilient means connecting the anterior support section with the posterior support section for flexible change of distance between the anterior support section and the posterior support section;

wherein if the anterior support section has at least one of: a medial segment, or a lateral segment, then the anterior support section has a frontal point configured for being directed towards the front of the nose when the nasal filter is inserted into a nose; and the posterior support section has a backmost point configured for being directed towards the back of the nose when the nasal filter is inserted into a nose;

wherein the anterior support section has an anterior support surface for supporting the filter element; and wherein the posterior support section has a posterior support surface for supporting the filter element; wherein the anterior support surface is angled with an angle in the interval of 5 to 40 degrees relative to the posterior support surface when the angle is measured along a curved line from the backmost point to the frontal point in order for supporting the filter element in a bent state;

wherein a) the anterior support section has a medial segment and a lateral segment and extends from a medial side to a lateral side of the nose along an anterior inner part of the nose when inserted into the nose, and the posterior support section has a medial sector and a lateral sector and extends along a posterior inner part of the nose when inserted into the nose; the resilient means comprising a medial resilient member flexibly connecting the medial segment with the medial sector; whereby the medial sector, the medial resilient member, and the medial segment in combination form a medial side of the frame portion configured for being directed towards the septum when the nasal filter is inserted into a nose; the medial resilient member being configured for flexible change of distance between the medial segment and the medial sector; wherein the medial resilient member, when the nasal filter is in a relaxed state, comprises a medial bend as a resilient connection between the medial sector and the medial segment; wherein the anterior support section has an anterior support surface for supporting the filter element; and the posterior support section has a posterior support surface for supporting the filter element, wherein the anterior support surface and the posterior support surface define a bent filter support plane for the filter element; wherein the shape of the filter element follows this filter support plane when the nasal filter is in a relaxed state; wherein the medial bend extends outside the filter support plane when the nasal filter is in a relaxed state;

or b) the anterior support section has a lateral segment, and the posterior support section has a lateral sector; the resilient means comprising a lateral resilient member flexibly connecting the lateral segment with the lateral sector; whereby the lateral sector, the resilient means, and the lateral segment in combination form a lateral side of the frame portion configured for being directed towards the lateral part of the nose when the nasal filter is inserted into a nose; the lateral resilient member being configured for flexible change of distance between the lateral segment and the lateral sector; wherein the lateral resilient member, when the nasal filter is in a relaxed state, comprises a lateral bend as a resilient connection between the lateral sector and the lateral segment; wherein the anterior support section has an anterior support surface for supporting the filter element; and the posterior support section has a posterior support surface for supporting the filter element, wherein the anterior support surface and the posterior support surface define a bent filter support plane for the filter element; wherein the shape of the filter element follows this filter support plane when the nasal filter is in a relaxed state; wherein the lateral bend extends outside the filter support plane when the nasal filter is in a relaxed state;

or both a) and b).

16. A nasal filter comprising a left and right frame portion dimensioned for placement inside a left and right nostril of a nose, respective;

each frame portion comprising an anterior support section configured for being directed towards a front of the nose when the nasal filter is inserted into the nose; each frame portion being made from a flexible polymer material; and each frame portion comprising a posterior support section configured for being directed towards a back of the nose when the nasal filter is inserted into the nose;

the anterior support section and the posterior support section supporting a filter element;

each frame portion comprising resilient means connecting the anterior support section with the posterior support section for flexible change of distance between the anterior support section and the posterior support section;

wherein the anterior support section of each frame portion has a frontal point configured for being directed towards the front of the nose when the nasal filter is inserted into a nose; and the posterior support section of each frame portion has a backmost point configured for being directed towards the back of the nose when the nasal filter is inserted into a nose; the two frontal points and the two backmost points defining a reference plane with a normal vector perpendicular to the reference plane;

wherein the posterior support section has a medial sector and a lateral sector, where the medial sector is near or at the septum and the lateral sector near or at the lateral wall of the nostril when the nasal filter is inserted into the nose; wherein the posterior support section has a downwards or upwards slope in the direction from the medial sector towards the lateral sector; the downwards or upwards slope forming an angle in the interval of 45-85 degrees with the normal vector;

wherein a) the anterior support section has a medial segment and a lateral segment and extends from a medial side to a lateral side of the nose along an anterior inner part of the nose when inserted into the nose, and the posterior support section extends along a posterior inner part of the nose when inserted into the nose; the resilient means comprising a medial resilient member flexibly connecting the medial segment with the medial sector; whereby the medial sector, the medial resilient member, and the medial segment in combination form a medial side of the frame portion configured for being directed towards the septum when the nasal filter is inserted into a nose; the medial resilient member being configured for flexible change of distance between the medial segment and the medial sector; wherein the medial resilient member, when the nasal filter is in a relaxed state, comprises a medial bend as a resilient connection between the medial sector and the medial segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the medial bend extends outside the filter support plane when the nasal filter is in a relaxed state;

or b) the anterior support section has a lateral segment; the resilient means comprising a lateral resilient member flexibly connecting the lateral segment with the lateral sector; whereby the lateral sector, the resilient means, and the lateral segment in combination form a lateral side of the frame portion configured for being directed towards the lateral part of the nose when the nasal filter is inserted into a nose; the lateral resilient member being configured for flexible change of distance between the lateral segment and the lateral sector; wherein the lateral resilient member, when the nasal filter is in a relaxed state, comprises a lateral bend as a resilient connection between the lateral sector and the lateral segment; wherein the anterior support section has an anterior support surface for supporting the filter element; and the posterior support section has a posterior support surface for supporting the filter element, wherein the anterior support surface and the posterior support surface define a straight or bent filter support plane for the filter element; wherein the shape of the filter element follows this filter support plane when the nasal filter is in a relaxed state; wherein the lateral bend extends outside the filter support plane when the nasal filter is in a relaxed state;

or both a) and b).

17. A nasal filter according to claim 1, wherein the filter element is planar.

* * * * *